US006234314B1

(12) United States Patent
Qiu et al.

(10) Patent No.: US 6,234,314 B1
(45) Date of Patent: May 22, 2001

(54) PACKAGE SUPPORT POST WITH JOINED SURFACES

(75) Inventors: Yanping Qiu, Middleton, WI (US); Donald E. Widman, Nashville, TN (US)

(73) Assignee: Sonoco Development, Inc., Hartsville, SC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/385,504

(22) Filed: Aug. 30, 1999

(51) Int. Cl.[7] ..... B65D 81/133
(52) U.S. Cl. ..... 206/586; 206/320
(58) Field of Search ..... 52/717.05; 206/586, 206/591, 594, 453, 320; 248/345.1

(56) References Cited

U.S. PATENT DOCUMENTS

| | | | | |
|---|---|---|---|---|
| 2,951,252 | * | 9/1960 | Roche | 248/345.1 |
| 3,138,834 | * | 6/1964 | Shanok et al. | 52/717.05 |
| 3,144,236 | * | 8/1964 | Clanin | 248/345.1 |
| 3,648,920 | * | 3/1972 | Stump | 206/586 |
| 3,725,188 | * | 4/1973 | Kalt | 206/586 |
| 3,935,357 | * | 1/1975 | Padovani | 206/594 |
| 3,982,682 | | 9/1976 | Fremion . | |
| 4,482,054 | * | 11/1984 | Gardner | 206/586 |
| 4,483,444 | * | 11/1984 | Gardner | 206/586 |
| 4,811,840 | | 3/1989 | Muyskens . | |
| 5,267,651 | * | 12/1993 | Hughes | 206/586 |
| 5,593,039 | * | 1/1997 | Ortlieb | 206/586 |
| 6,035,613 | | 3/2000 | Lencoski et al. . | |

FOREIGN PATENT DOCUMENTS

| | | | | |
|---|---|---|---|---|
| 4-294763 | * | 10/1992 | (JP) | 206/586 |

* cited by examiner

*Primary Examiner*—Jim Foster
(74) *Attorney, Agent, or Firm*—Bullwinkel Partners, Ltd.

(57) ABSTRACT

A product support such as a corner post used for cushioning and supporting large appliances is provided. The support post comprises spaced substantially parallel opposing walls connected at the ends. The opposing walls have at least one area of contact spaced from the ends wherein the opposing walls are joined along at least part of the area of contact. The opposing walls may be joined by adhesive, stitching, or other suitable means.

10 Claims, 6 Drawing Sheets

PACKAGE SUPPORT POST WITH JOINED SURFACES

BACKGROUND

1. Field of the Invention

This patent relates to packaging for large products such as washers, dryers and refrigerators. More particularly, this patent relates to a tubular-type package support post in which adjacent surfaces are joined to prevent slippage between the surfaces so that the post is stiffened along both axial and lateral directions.

2. Description of the Related Art

Package support posts such as corner posts or wall posts consisting essentially of wound paper tubes are used to support and cushion large, heavy appliances (such as washers, dryers, refrigerators, dishwashers and stoves) during storage and transport. Conventional tubular-type support posts are made of a single sheet of paper wound into a convolute (coiled) tube. Adhesive is often used to bond the paper layers. Before the adhesive dries, the tube is shaped into the desired shape. In the case of a corner post, the desired shape typically has a modified "L" shaped cross section to fit snugly about the corner of an appliance or other product.

U.S. Pat. No. 4,482,054, issued to Gardner, discloses one such corner post having longitudinally-extending grooves or indentations to provide improved resistance to longitudinally directed compression forces and enhanced cushioning against laterally directed forces. Indentations on opposing walls are aligned so as to contact each other, thereby defining cylinders separated by the contact areas. The opposing walls are not adhered or bonded to each other at the contact areas. As a result, the exertion of forces, particularly laterally directed horizontal forces, will cause slippage between the contacting surfaces. The problem is exacerbated when the ends of the corner post are rounded, because rounded ends are susceptible to rolling.

One consequence of not joining the contact areas between opposing walls is a reduction in buckling resistance. For example, a vertical compression force impinging on one wall can cause buckling of that wall while the opposing wall remains stable.

Another disadvantage of not joining contact areas is that it results in a reduction in lateral compression stiffness. For example, when subjected to a lateral compression force, one wall can slip with respect to the opposite wall. Users of packaging supports such as corner posts often require high lateral compression stiffness to prevent their products from being damaged by impacts along the lateral direction.

The present invention overcomes these and other disadvantages by providing an improved corner post in which areas of contact between opposing walls are joined together. The opposing walls may be joined by adhesive, stitching, or any other suitable means. Joining opposing walls along the areas of contact prevents relative movement between the opposing walls which allows the walls to support each other. Joining opposing walls also improves the lateral stiffness of the entire structure.

Thus it is an object of the present invention to provide a support post made from a continuously formed wrap of material which is reformed into a corner or wall post having opposing walls in which areas of contact between the walls are joined together.

Another object of the present invention is to prevent relative movement between the contact surfaces of opposing walls of a tubular corner post so the entire structure is stiffened.

Still another object of the present invention is to provide a support post in which the opposing walls do not quite contact each other but are nevertheless joined together.

Further and additional objects will appear from the description, accompanying drawings, and appended claims.

SUMMARY OF THE INVENTION

The present invention is a support post for use in the packaging of a product. The support post is made from convolutely wound material which, when formed into a desired shape, comprises spaced substantially parallel opposing walls connected at the ends. The opposing walls have at least one area of contact apart from the ends wherein the opposing walls are joined along at least part of the area of contact. The area of contact may be joined by adhesive, stitching, or other suitable means.

THE DRAWINGS

DETAILED DESCRIPTION OF THE INVENTION

Figure 1:
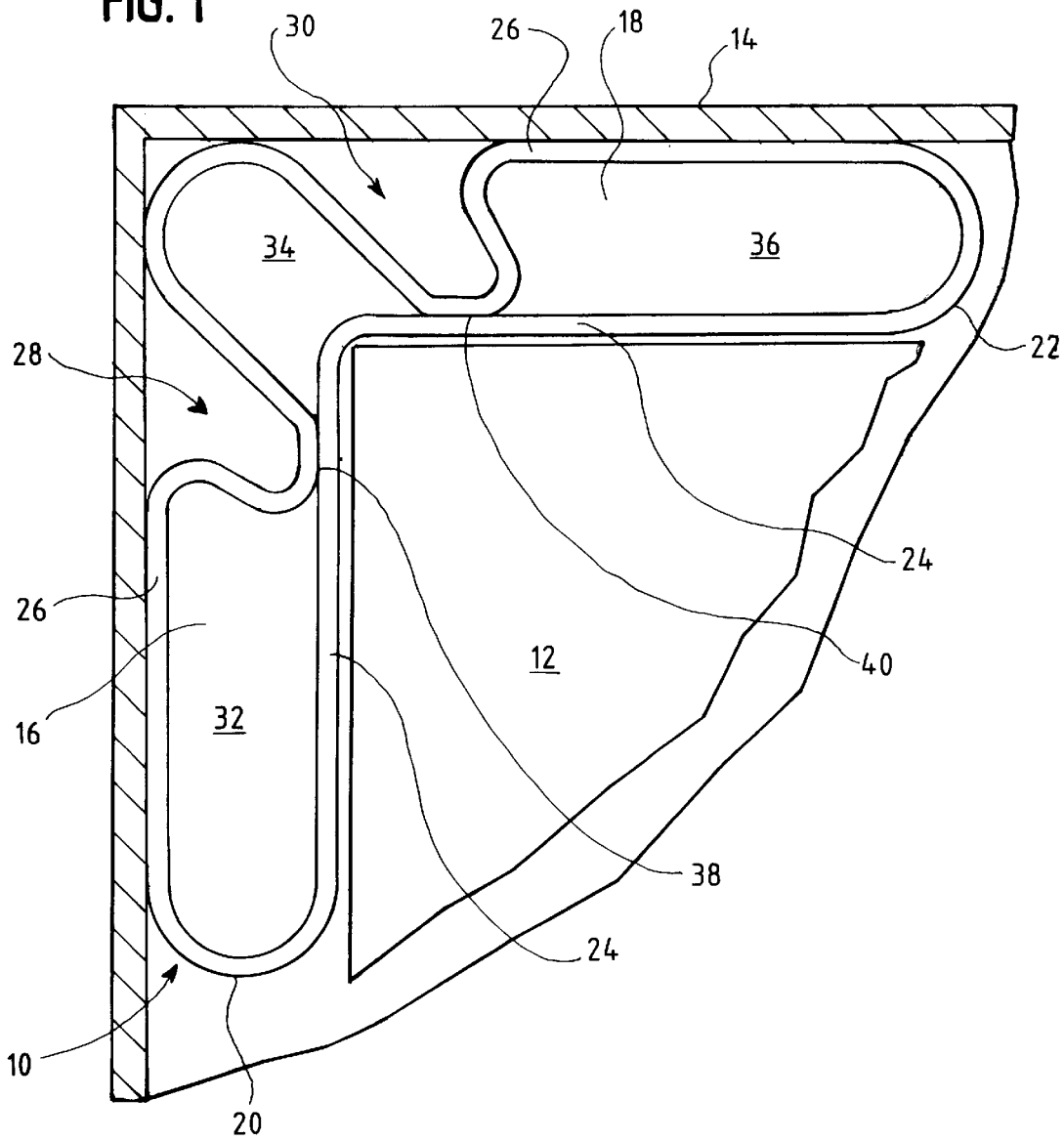
FIG. 1 is a cross-sectional view of the corner post of the present invention illustrating its position relative to a product within a package.

Turning to the drawings, there is shown in FIG. 1 a corner post 10 according to the present invention illustrating its position relative to a product 12 and a package 14. The product 12 typically is a large, heavy appliance such as a washer, dryer or refrigerator. The corner post 10 is interposed between the product 12 and the package 14 in confining engagement therewith.

The corner post 10 may be formed of paper or paperboard convolutely wound into a tubular configuration and formed into a desired shape. The corner post 10 normally extends from a base pad located beneath the product 12 at the bottom of the package 14 to a top cap or lid to help support the package 14 against vertical (axial) forces, such as when packages are stacked. In addition, the corner post 10 protects and cushions the product 12 from horizontal (lateral) forces, such as during handling.

In the embodiment shown in FIG. 1 the corner post 10 comprises two legs 16, 18 substantially perpendicular to each other which terminate in integrally formed rounded ends 20, 22. The legs 16, 18 are formed by an inner wall 24 (being defined as the wall closest to the product) and an outer wall 26 in generally parallel spaced relation to each other. The corner post 10 has a substantially L-shaped cross section.

Figure 2:
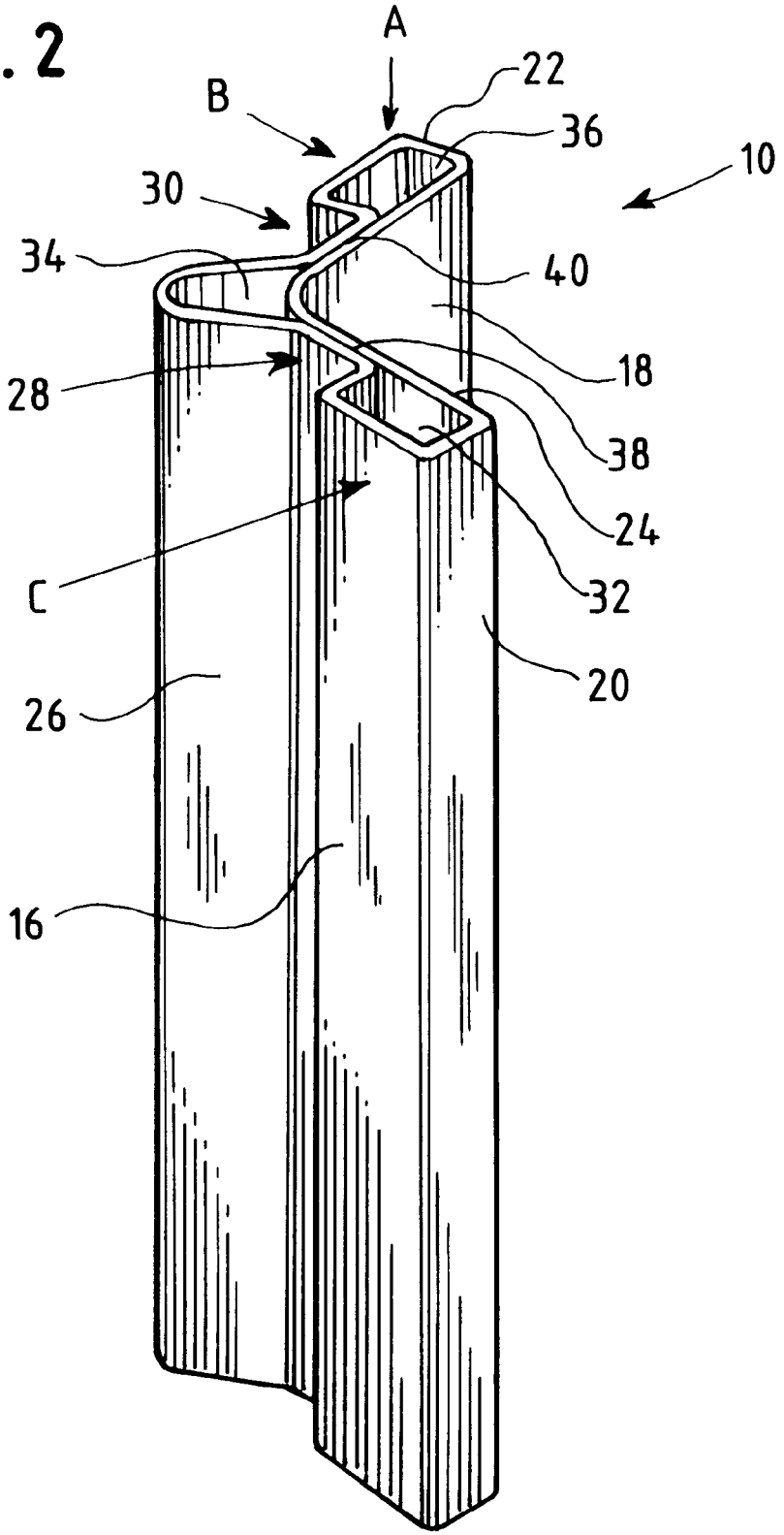
FIG. 2 is a perspective view of the corner post of FIG. 1 shown without the product or the package and showing the direction of various forces that such a corner post is likely to encounter during use.

In the embodiment shown in FIG. 1, an inwardly extending bead or groove 28, 30 (defined as a bead extending toward the product) is formed in the outer wall 26 along each leg 16, 18 at a point spaced from the rounded ends 20, 22. As best shown in FIG. 2, the beads 28, 30 extend the entire vertical length of the outer wall 26. As in conventional corner posts of this type, the beads 28, 30 may contact the inner wall 24, thus forming multiple enclosed areas 32, 34, 36 within the corner post 10.

The improvement lies in joining the outer wall beads 28, 30 to the inner wall 24 along some or all of the areas of contact 38, 40. Joining the opposing walls 24, 26 increases the axial compression strength of the corner post 10 and the side wall compression stiffness by preventing slipping or moving of one wall relative to the other. As a result, the present invention is better able to withstand axial (vertical) forces and lateral (horizontal) forces.

By joining the contact areas 38, 40 between opposing walls 24, 26, the two walls 24, 26 support each other horizontally. This increases the stability of the structure 10 and decreases the chances that one or both walls will buckle under axial compression forces.

The inner and outer walls 24, 26 may be joined by adhesive, stitching, staples or any other suitable means. Preferably the opposing walls 24, 26 are joined along the entire length of the contact areas 38, 40, although it is anticipated that the walls 24, 26 may be joined along less than the entire length, such as with spot gluing.

FIG. 2 provides a perspective view of the corner post 10 of FIG. 1 without the product and packaging. Arrow A indicates the direction of axial compression forces, which might be caused by stacking one package on top of another. Arrows B and C indicate the direction of lateral forces which might be caused by handling the package.

Figure 3:
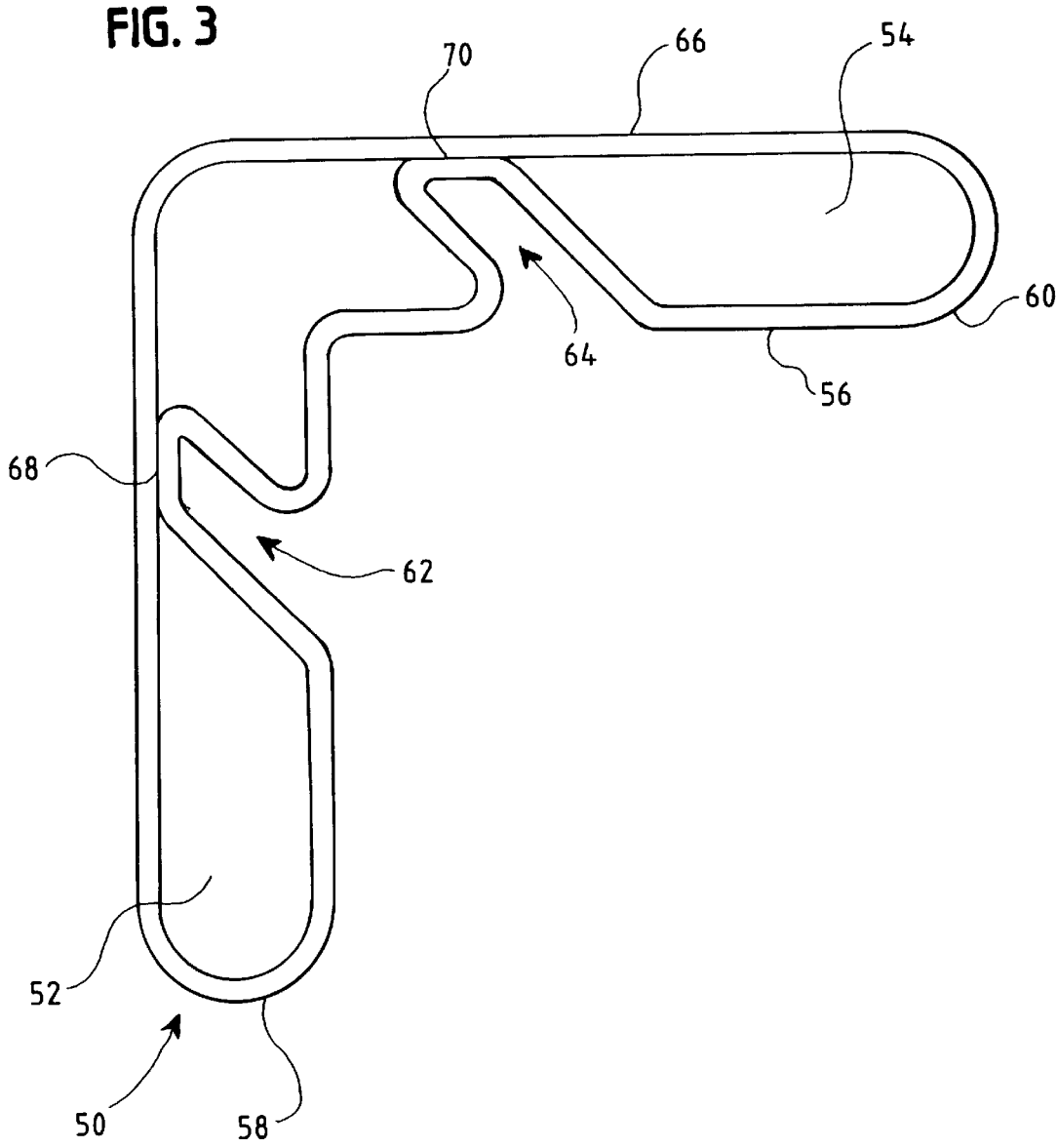
FIG. 3 is a cross-sectional view of a second embodiment of the present invention.

In the alternative embodiment 50 shown in FIG. 3, along each leg 52, 54 of the corner post 50 the inner wall 56 includes, at a point spaced from the rounded ends 58, 60, an outwardly extending bead 62, 64 (i.e., a bead extending away from the product) running the entire vertical length of the inner wall 56. The inner and outer walls 56, 66 are joined together along some or all of the areas 68, 70 where the beads 62, 64 contact the outer wall 66.

Figure 4:
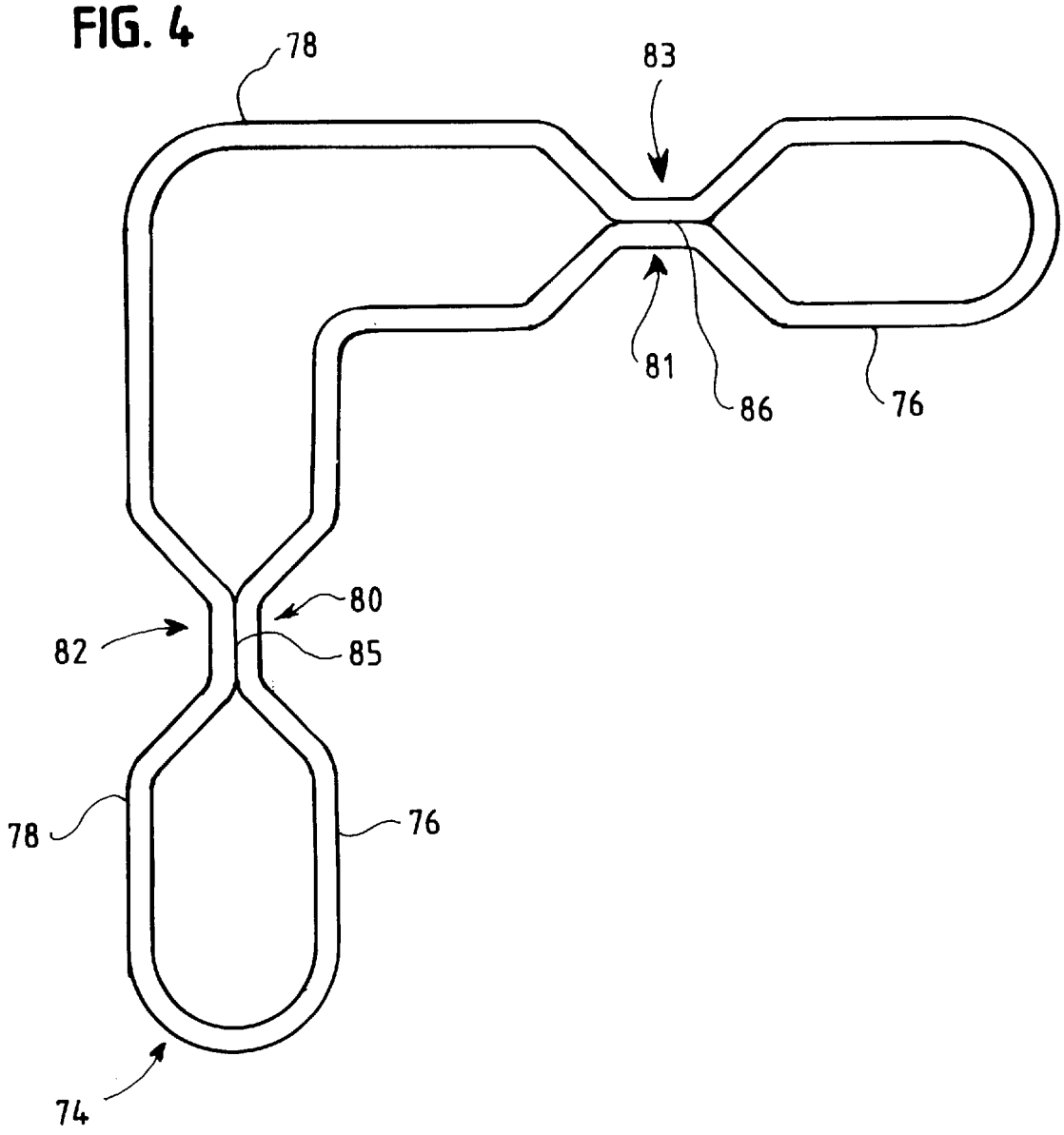
FIG. 4 is a cross-sectional view of a third embodiment of the present invention.

In yet another embodiment 74 shown in FIG. 4, the inner wall 76 and the outer wall 78 have corresponding aligned beads 80, 81, 82, 83. The inner and outer walls 76, 78 are in contact along the areas 85, 86 where the beads 80, 81, 82, 83 are in alignment with each other. At some or all of the areas of contact 85, 86, the inner and outer walls 76, 78 are joined together.

While the previous examples were all directed to a corner post, it will now be shown that the present invention is applicable to convolutely wound wall posts or supports as well. A convolutely wound wall support 90, such as that shown in FIG. 5, comprises a pair of spaced parallel walls 92, 93 which are connected by longitudinally extending rounded end sections 94, 95 to form a flattened tube. The wall support 90 may be placed between an appliance and a package at locations other than the corners of the package. If only a single wall support is used in conjunction with each side of the package, the support is preferably located midway between the corners.

The wall support 90, like the corner posts, is provided with longitudinally extending beads 96, 97, 98, 99 spaced from the ends 94, 95. In the embodiment shown in FIG. 5, a pair of beads 96, 98 formed in one wall 92 is substantially aligned with a pair of beads 97, 99 formed in the opposing wall 93. The interior aligned surfaces of the beads 96, 97, 98, 99, are in contact with each other and are joined along some or all of the contact areas 102, 104. As a result, the resistance of the wall support 90 to compressive and lateral forces is enhanced.

Figure 5:
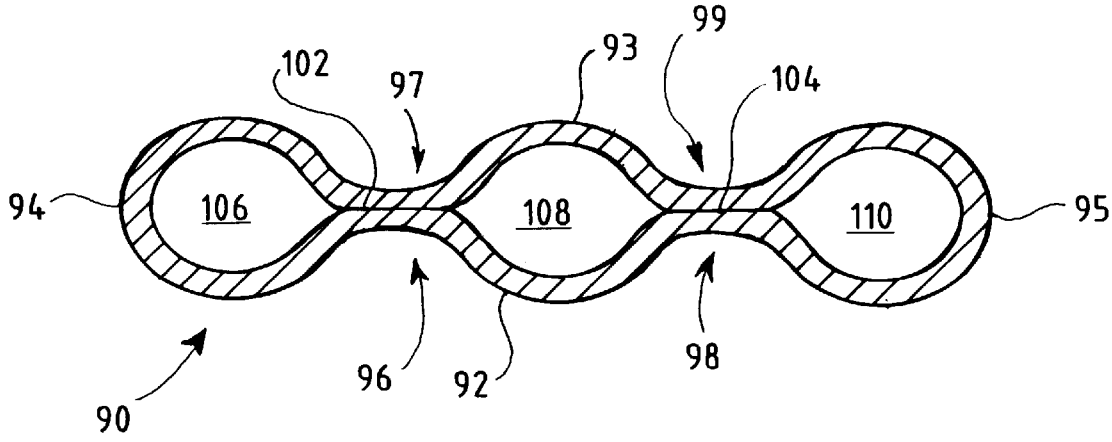
FIG. 5 is a cross-sectional view of a fourth embodiment of the present invention.

Still referring to FIG. 5, the contact areas 102, 104 of the wall support 90 divide the wall support 90 into three adjacent cylinders 106, 108, 110. By joining the contact areas 102, 104, a compression force impinging on one cylinder is shared by adjacent cylinders, thus decreasing the chances that the wall support 90 will buckle under an axial compression load.

Figure 6:
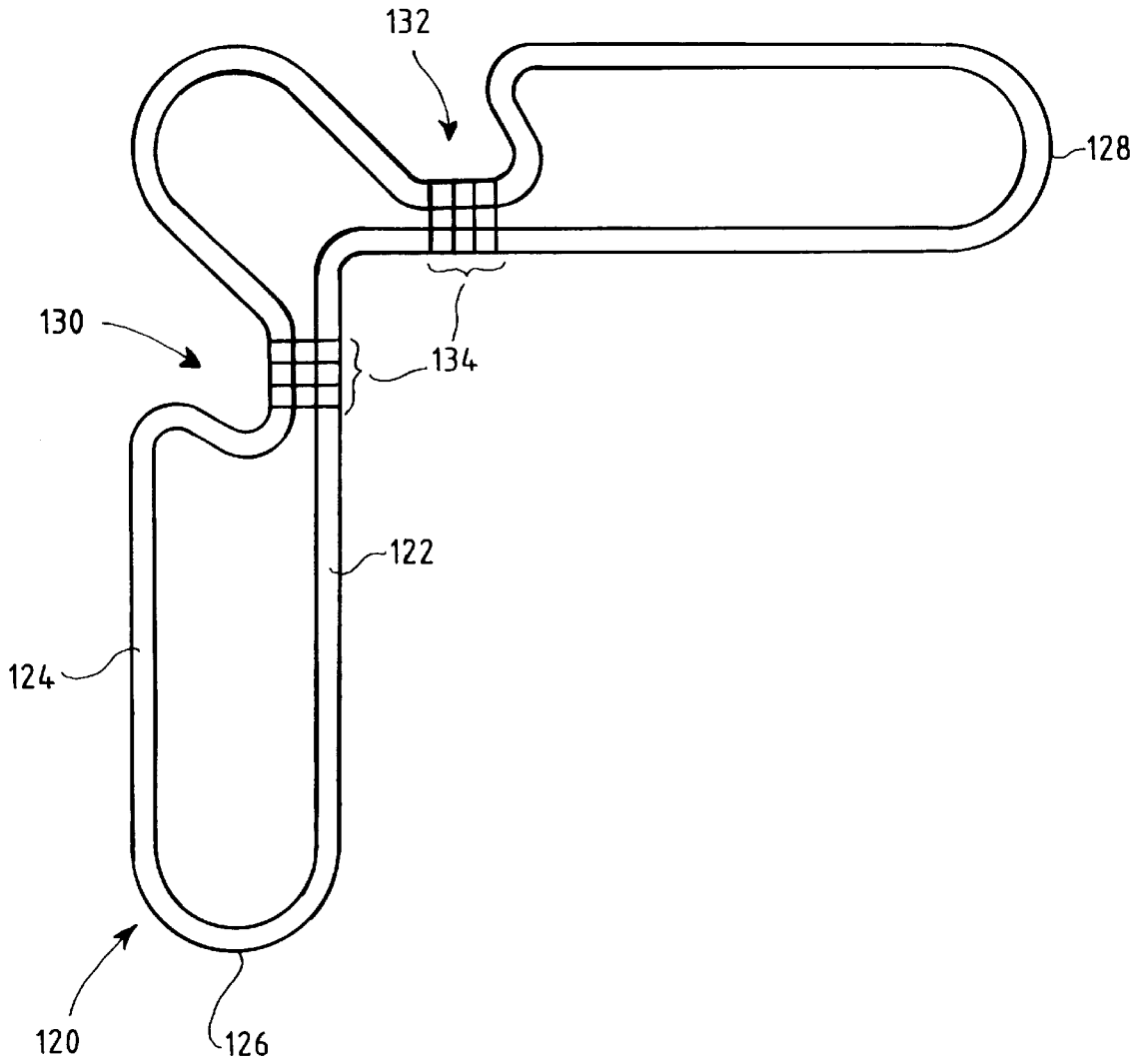
FIG. 6 is a cross-sectional view of still another embodiment of the present invention, in which the opposing walls of a support post are joined but are not in contact with each other except at the ends.

FIG. 6 shows still another embodiment of the present invention, in which the opposing walls 122, 124 of a support post 120 are joined but are not in contact with each other except at the ends 126, 128. The support post 120 comprises inner and outer opposing walls 122, 124 connected at their respective ends to define a hollow space therebetween. The post 120 has a bead defined by each leg of the outer wall 124. Each bead 130, 132 extends toward the inner wall 122 but is not in contact with the inner wall 122. The beads 130, 132 and the inner wall 122 may be joined by stitching 134 or other suitable means. The stitching 134 helps to improve axial compression strength of the post.

As with the previous embodiments, it will be appreciated that the number of beads, as well as their orientation, may vary from that shown in FIG. 6. For example, and without limiting the scope of the invention, the beads may be formed in the inner wall instead of the outer wall, or there may be more than one bead located along each leg of the post.

The invention may be used to cushion and support large appliances during storage and transport. After manufacture, the appliance typically is placed on and fastened to a pallet or base having upwardly extending perimeter walls. The pallet typically has dimensions greater than the width and depth of the appliance to accommodate corner posts and/or wall supports. The corner posts and wall supports are inserted around the appliance to protect the appliance from scratching and denting during shipping and handling. A protective sleeve made of paperboard or corrugated board is placed over the appliance to form the four sidewalls of the container and fits inside the perimeter of the base. A paperboard or corrugated top serves as a container lid. Straps may be wrapped around the container to better secure the corner posts and wall supports between the appliance and the container. The packaged appliances may be stacked on top of each other.

Axial (vertical) compression strength of corner posts is a critical performance requirement for stacking appliance packages. Horizontal cushioning stiffness is also important for resistance to clamping forces. The corner post of the present invention is better capable of resisting vertical and horizontal forces than conventional tubular corner posts.

Other modifications and alternative embodiments of the invention are contemplated which do not depart from the spirit and scope of the invention as defined by the foregoing teachings and appended claims. It is intended that the claims cover all such modifications that fall within their scope.

We claim as our invention:

1. A generally L-shaped elongated corner post for use in the packaging of a product, said corner post comprising rigid inner and outer opposing walls connected at their respective ends, said inner and outer opposing walls having at least one area of contact spaced from the ends, wherein said inner and outer opposing walls are joined by stitching along at least part of the area of contact so that the inner and outer walls cannot slide or move with respect to each other at the area of contact.

2. A support post for use in the packaging of a product, said post comprising inner and outer opposing walls connected at their respective ends to define a hollow space therebetween, said post comprising at least one bead defined by one of said inner and outer opposing walls, said bead extending toward the opposing wall but not in contact with the opposing wall, wherein said bead and said opposing wall are joined.

3. The support post of claim 2 in which the bead and opposing wall are joined by stitching.

4. A generally L-shaped corner post for use in the packaging of a product, comprising inner and outer opposing walls connected at their respective ends, said inner and outer opposing walls having at least one area of contact spaced from the ends, wherein said inner and outer opposing walls are joined by stapling along at least part of the area of contact.

5. An elongated corner post for use in the packaging of a product, said corner post comprising rigid inner and outer opposing walls connected at their respective ends to form a substantially hollow tube, said inner wall having an inner corner and substantially flat first and second portions joined at the inner corner to form a substantially right angle, said outer wall having an outer corner and substantially flat first and second portions joined at the outer corner to form a substantially right angle, at least one portion of said outer wall having a bead, the bead having an apex and extending inwardly toward the inner wall such that the apex contacts a substantially flat surface of the inner wall and is joined thereto such that the inner and outer walls cannot slide or move with respect to each other at the area of contact.

6. The corner post of claim 5 wherein the outer wall bead apex and the flat surface of the inner wall are joined by adhesive.

7. The corner post of claim 5 wherein both the first and second portions of the outer wall have a bead that extends inwardly toward the inner wall such that each bead apex contacts a substantially flat surface of the inner wall and is joined thereto.

8. An elongated corner post for use in the packaging of a product, said corner post comprising rigid inner and outer opposing walls connected at their respective ends to form a substantially hollow tube, said outer wall having an outer corner and substantially flat first and second portions joined at the outer corner to form a substantially right angle, said inner wall having an inner corner and substantially flat first and second portions joined at the inner corner to form a right angle, at least one portion of said inner wall having a bead, the bead having an apex and extending outwardly toward the outer wall such that the apex contacts a substantially flat surface of the outer wall and is joined thereto such that the inner and outer walls cannot slide or move with respect to each other at the area of contact.

9. The corner post of claim 8 wherein the inner wall bead apex and the flat surface of the outer wall are joined by adhesive.

10. The corner post of claim 8 wherein both the first and second portions of the inner wall have a bead that extends outwardly toward the outer wall such that each bead apex contacts a substantially flat surface of the inner wall and is joined thereto.

* * * * *